United States Patent [19]

Canup et al.

[11] 4,342,305

[45] Aug. 3, 1982

[54] IGNITION SYSTEM FOR AN INTERNAL COMBUSTION ENGINE EMPLOYING FUEL INJECTION

[75] Inventors: Robert E. Canup, Poughkeepsie; Martin Alperstein, Fishkill, both of N.Y.

[73] Assignee: Texaco Inc., White Plains, N.Y.

[21] Appl. No.: 200,753

[22] Filed: Oct. 27, 1980

Related U.S. Application Data

[63] Continuation of Ser. No. 48,867, Jun. 15, 1979, abandoned.

[51] Int. Cl.[3] ..... F02B 15/00; F02M 63/06

[52] U.S. Cl. ..... 123/617; 123/445; 123/594

[58] Field of Search ..... 123/445, 617, 444, 472, 123/490, 612, 626, 643, 151, 152, 594, 608

[56] References Cited

U.S. PATENT DOCUMENTS

| | | | |
|---|---|---|---|
| 4,066,059 | 1/1978 | Mayer et al. | 123/151 |
| 4,096,841 | 6/1978 | Kindermann et al. | 123/617 |
| 4,111,178 | 9/1978 | Casey | 123/617 |
| 4,172,439 | 10/1979 | Pasbrig | 123/608 |

*Primary Examiner*—Raymond A. Nelli

*Attorney, Agent, or Firm*—Carl G. Ries; Robert A. Kulason; Henry C. Dearborn

[57] ABSTRACT

An ignition system for an internal combustion engine which employs fuel injection. It uses the injection valve plungers to initiate spark control signals when they lift due to the fuel injection pressure. An electronic comparator output provides the control signal.

6 Claims, 3 Drawing Figures

IGNITION SYSTEM FOR AN INTERNAL COMBUSTION ENGINE EMPLOYING FUEL INJECTION

This is a continuation, of application Ser. No. 06/048,867, filed June 15, 1979, now abandoned.

BACKGROUND OF THE INVENTION

1. Field of the Invention

This invention concerns an ignition system which is particularly applicable to a diesel type engine that employs spark assist. The designation diesel type engine is intended to include a fuel injection system where the fuel pressure acts to lift the fuel injection valves.

2. Description of the Prior Art

Heretofore, a system has been disclosed for employing a fuel injection valve to generate an electrical signal in order to control an ignition signal that is applied to the cylinder related to each such fuel valve. That system is disclosed in U.S. Pat. No. 4,066,059 issued Jan. 3, 1978 and assigned to the same assignee as this application. The ignition system in that patent makes use of direct amplification of the injection valve initiated signal in order to control the generation of a high voltage spark signal. Furthermore, the injection valve employed in that patent requires special electrical insulating material elements to isolate the valve needle, or plunger from the body of the valve except where it touches the valve seat when closed.

Another known suggestion was related to using a fuel injection needle valve to act as a switch for operating test equipment in order to monitor a fuel injection nozzle. That arrangement is disclosed in U.S. Pat. No. 3,942,366, issued Mar. 9, 1976. However, the electrical switch structure is separate from the valve plunger and seat, so that special valve and switch structures are involved which add cost to the ordinary valve construction.

Consequently, it is an object of this invention to provide a system for generating a signal to control a spark voltage for an internal combustion engine which signal originates at the injector valve of ordinary construction when the fuel pressure lifts the valve plunger.

Another object of this invention is to provide an electrical ignition system which can develop a clean ignition initiating spark signal that has a desired duration for each spark, and that overcomes the drawbacks in connection with the foregoing prior art.

SUMMARY OF THE INVENTION

Briefly, the invention relates to a combination with an internal combustion engine which employs fuel injection and includes a high tension electric spark to ignite a combustible mixture of said injected fuel. The combination comprises a fuel injection valve having an electrically conductive material plunger in seating contact with an electrically conductive material body of the valve when closed, the said plunger being actuated by fuel pressure to open the valve. It also comprises first electrical circuit means for connecting a resistor in series with said plunger, and a comparator having two inputs and an output. It also comprises second circuit means for connecting a predetermined EMF to one of said comparator inputs, and third circuit means for connecting the other said comparator inputs to said plunger. The said comparator output provides a signal to initiate said electric spark when said plunger is actuated by the fuel pressure.

Once more briefly, the invention concerns a system that is in combination with an internal combustion engine employing fuel injection and including a high tension electrical spark to ignite a combustible mixture of said injected fuel. The combination comprises a plurality of fuel injection valves, each having an electrically conductive material plunger in seating contact with an electrically conductive material body of each valve when closed, the said plungers being actuated by fuel pressure to open the valves. It also comprises ignition breaker points which are engine actuated to open after each of said fuel injection valves when operating normally, and first electrical circuit means for connecting a resistor in series with each of said plungers and with said breaker points. It also comprises a first and second comparator each having two inputs and an output, and second circuit means for connecting a predetermined EMF to one of each of said comparator inputs in parallel. It also comprises third circuit means comprising a diode in series with each of said plungers and said breaker points for maintaining electrical separation thereof. The said third circuit means connects said plungers and said breaker points to the other input of said first comparator. The said first comparator output provides a signal to initiate said electric sparks whenever any of said plungers are actuated by the fuel pressure or said breaker points are actuated, and it comprises time delay means connected to said first comparator output for maintaining said signal a predetermined time duration. The said time delay means comprises an RC circuit, and said second comparator. The time delay means also comprises fourth circuit means for connecting said RC circuit between said first comparator output and the other input of said second comparator. The time delay means also comprises fifth circuit means for connecting the output of said second comparator to said other input of said first comparator.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein:

FIG. 2 is another schematic circuit diagram illustrating the arrangement for including a plurality of fuel injector valves connected to comparators for providing an ignition control signal to a spark generator or the like; and FIG. 3 is a schematic circuit diagram illustrating a complete system for applying ignition spark signals to an internal combustion engine, and employing a spark control circuit arrangement according to the invention.

DESCRIPTION OF THE PREFERRED EMBODIMENTS

It has been discovered that while the aforementioned U.S. Pat. No. 4,066,059 provided insulation at various points along the length of the valve plunger, such additional insulation is unnecessary. Thus, the fuel under pressure which lifts the valve plunger, forms a thin film of fuel between the valve plunger and the valve body.

This creates a high resistance path electrically, and consequently it is the basis for creating a control signal to be used with the ignition system.

Figure 1:
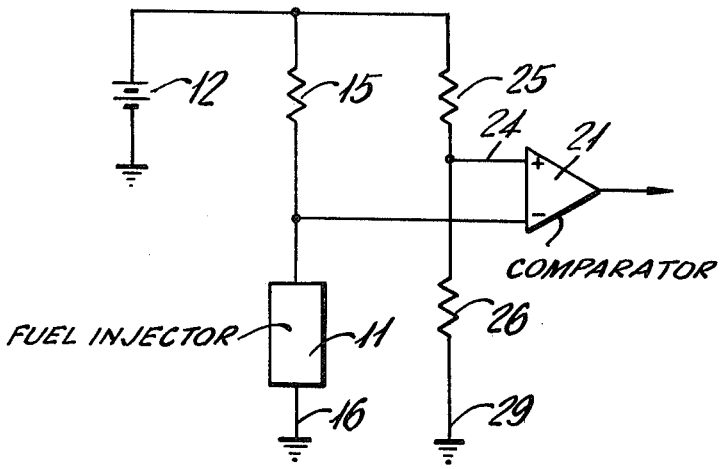
FIG. 1 is a schematic circuit diagram illustrating the basic arrangement of a fuel injector valve and a comparator.

In accordance with the foregoing basic discovery, an electrical system may be employed according to the FIG. 1 circuit. Such system includes a fuel injector 11 that is schematically indicated with the caption applied thereto. The injector 11 is connected into a circuit with a battery 12 and a resistor 15 in series with it. It will be understood that the body of the fuel injector valve (not shown) is grounded. This is indicated by a ground circuit 16, and the series circuit is completed through the ground connection of the battery 12.

It may be pointed out that when the fuel injector 11 has no fuel pressure applied thereto, the valve therein will be closed and consequently its plunger (not shown) will be in contact with the body (not shown) of the injector valve within the injector 11. In this state, the electrical potential at a point 19 on the circuit mentioned above will be substantially zero, or ground potential, so long as the plunger maintains contact with the body of the valve in the fuel injector 11.

The circuit point 19 is connected via a circuit connection 20 to a comparator 21. The circuit connection 20 forms one input to the comparator 21 while there is another input circuit connection 24 that forms the other input connection. The input circuit 24 applies a predetermined potential, or EMF to the comparator by reason of a potentiometer connection across the battery 12. The potentiometer is formed by a resistor 25 and another resistor 26. These are in series with one another and with the battery 12 via a grounded circuit connection 29.

It is important to note that the fuel injector 11 may be any of various standard type injectors so long as it has an electrically conductive material plunger which is in seating contact with an electrically conductive material body of the valve, when the valve is closed. And, of course, with the valve plunger structure such that an ungrounded electrical circuit may be electrically connected to it. Examples of such standard injector valves which are commercially available, include those manufactured by Stanadyne of Hartford, Connecticut and designated Roosa Master Pencil Nozzles. Another commercially available type is that manufactured by Robert Bosch, GMBH of Stuttgart, West Germany which has nozzle bodies designated KDALZ which take DLUZ nozzle tips, and bodies KDAL with tips DLLA.

It will be appreciated by anyone skilled in the art that the comparator 21 is a well known electronic circuit element which acts to create an output signal that goes from a high voltage (so long as the input on one of its two inputs is less than the predetermined voltage on the other input) to a low voltage when the input on that one of the inputs exceeds the predetermined voltage. In other words, whenever the input on the first indicated input exceeds the predetermined input on the other of the two comparator inputs, the comparator will switch to a low output, and it is this change that creates an output signal for use in an ignition system.

Figure 2:
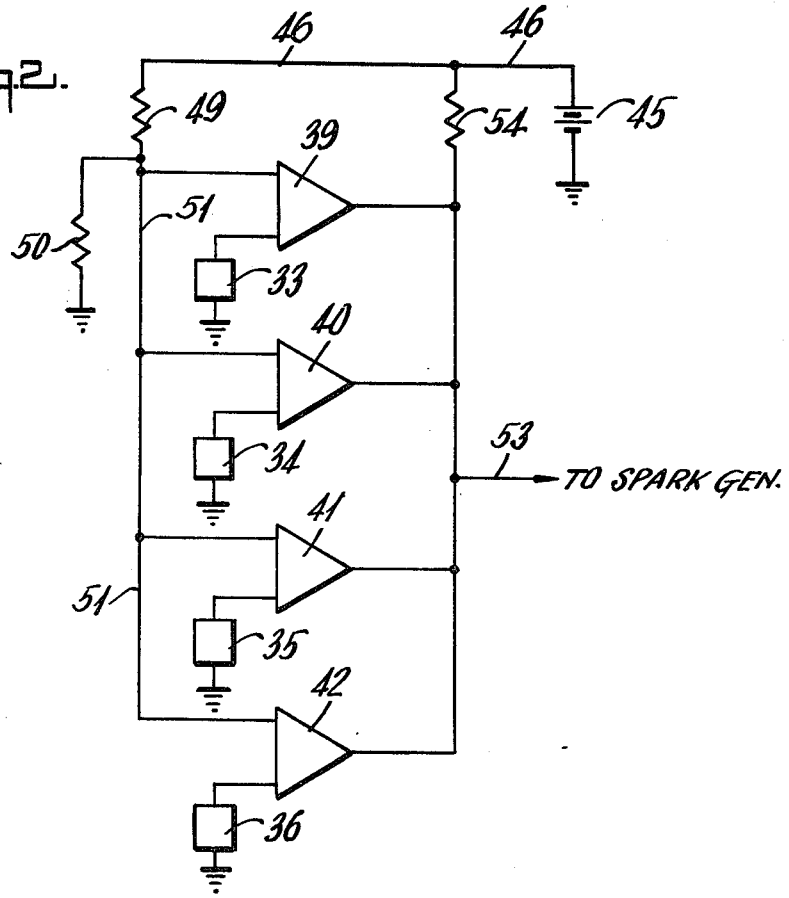
Figure 2:
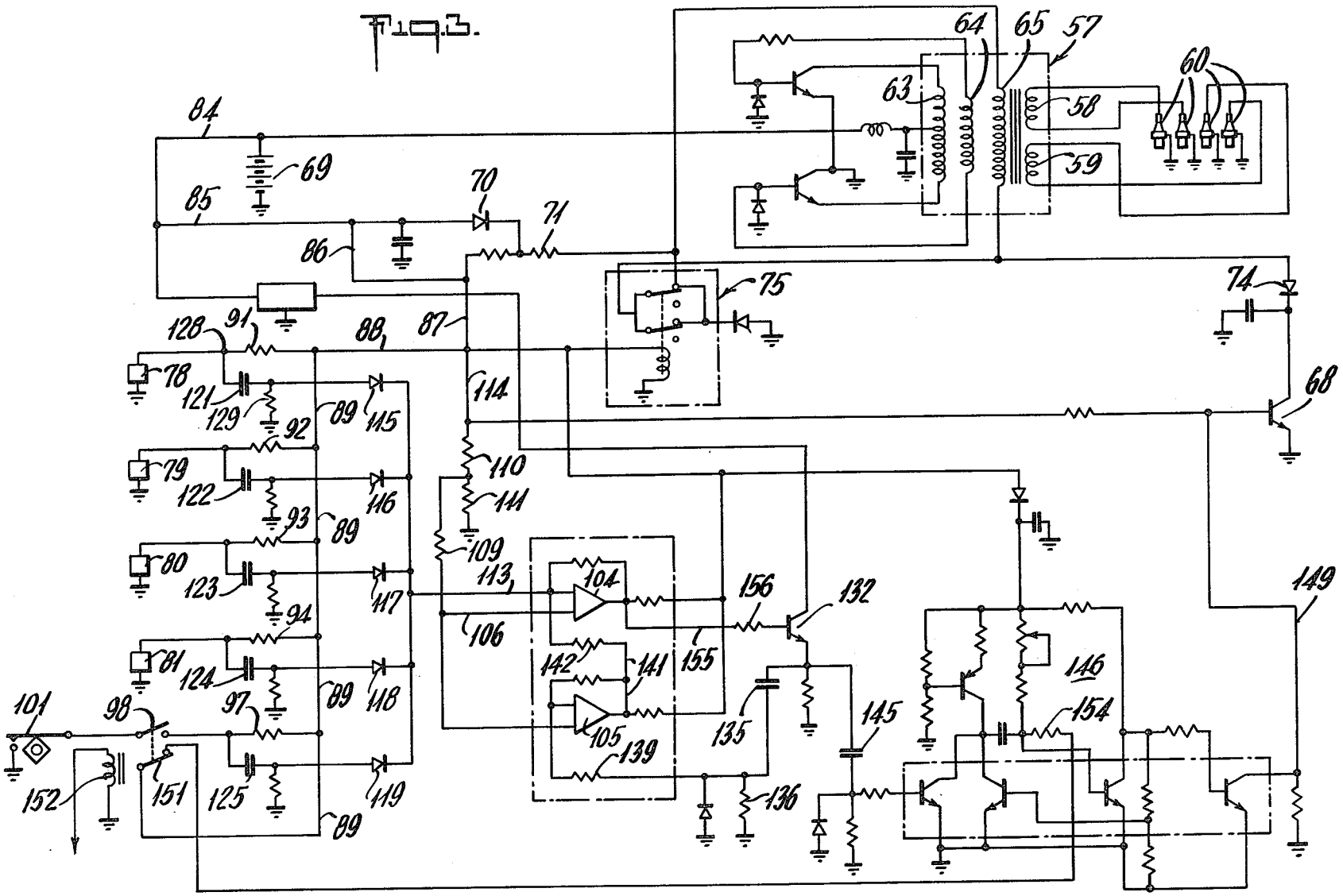

FIG. 2 illustrates an application of the basic principlies indicated above in connection with FIG. 1. This application is to a multi-cylinder engine (not shown) which includes a plurality of fuel injector valves 33 through 36 inclusive. Each of these fuel injector valves 33, 34, 35 and 36 is connected to one input of a corresponding plurality of comparators 39–42. It will be observed that in this case there is a potentiometer connected across a battery 45 which has one terminal grounded. The other terminal of battery 45 is connected via a circuit connection 46 to a pair of resistors 49 and 50 which are connected in series with one end of the resistor 50 connected to ground, as illustrated. This provides a predetermined EMF, or potential on a circuit connection 51 that is connected, in turn, to each of the comparators 39, 40, 41 and 42 in parallel. These parallel connections go to one of the inputs of each of the comparators 39–42. The other input of each comparator has one of the fuel injector valves 33–36, respectively, connected thereto.

It will be noted that the outputs of all of the comparators 39–42 are connected together to a single output circuit connection 53. This goes to a spark generator, as indicated by the caption. The signal on this output circuit 53 goes from a high voltage to a low (substantially ground) voltage whenever one of the comparators 39–42 switches state. Such change of output signal, i.e. voltage, is caused by the change from no current flow, to current flow through a resistor 54. It will be appreciated that the output signal on circuit connection 53 will not go directly to a distributor, but rather will act as a control signal for an ignition signal voltage which may be distributed.

FIG. 3 illustrates a practical ignition system circuit diagram which incorporates the basic invention and includes a time delay lockout circuit arrangement. The latter is for holding the injector valve-initiated signal long enough to overcome the uneven nature of the signal developed when a valve plunger is lifted off its seat as the fuel pressure acts upon it.

The high tension electric spark generating portion of the ignition system illustrated is like that shown and described in connection with a co-pending patent application Ser. No. 885,844 filed Mar. 13, 1978, and assigned to the same assignee as this application. However, it will be appreciated that the ignition system for generating spark signals may also be like various other systems such as that shown and described in connection with a U.S. Pat. No. 4,022,177 issued May 10, 1977 and earlier patents mentioned therein. All of the foregoing ignition systems employ a high-frequency square-wave spark signal that has a controlled duration during each sparking interval.

The aforementioned portion of the system is illustrated in the upper right hand part of FIG. 3. While the details of such a spark signal generating system are described in more detail in the various patents and the application mentioned above, it is explained briefly here. Thus, in FIG. 3 there is shown an output transformer 57 that supplies high voltage high-frequency spark signals from a pair of secondary, or output high-voltage windings 58 and 59 to a plurality of spark plugs 60 as indicated. The transformer 57 includes a center tapped primary winding 63, along with a feedback winding 64 which together are employed in an oscillator circuit such as is clearly explained in the above mentioned patents. In addition, there is a control winding 65 which controls the time duration of a continuous AC type spark as determined by the beginning and ending of periods of oscillation of the oscillator. Such oscillation control of stopping and starting is determined by an electronic switch, i.e. transistor 68. This transistor (spark control switch) is in series with a source of DC current supply which is a battery 69. The control circuit goes to the upper end (as viewed in FIG. 3) of the control winding 65 via a diode 70 and a resistor 71. The lower end of the control winding 65 goes to the transistor switch 68 via another diode 74.

There is a relay 75 shown that has circuit connections to the control winding 65. However, the details need not be described here as they are not relevant to this invention. The purpose is to ensure shut down of the oscillator whenever the ignition system is turned off.

The basic principles of this invention are described above in connection with the FIGS. 1 and 2 illustrations. In FIG. 3, a practical ignition system circuit for a four cylinder engine is shown. The system includes the invention as applied thereto. It shows a plurality of fuel injector valves 78, 79, 80 and 81 which are connected in parallel to the battery 69 via the illustrated circuit connections. Such circuit connections include a connection 84 from the positive terminal of the battery 69 to another circuit connection 85 which leads to a circuit connection 86 and connections 87 and 88 that connect to common circuit connector 89 for all of the injector valves 78–81, plus breaker points to be described below. These circuit connections go via individual resistors to be described, to the conductive material plunger (not shown) in each of the four fuel injector valves 78–81. However, there is a separate resistor 91, 92, 93 and 94 between the circuit connections 88 and 89 and each of the plungers of the valves 78–81. Similarly, the circuit connections 88 and 89 also lead to one end of another resistor 97 that has the other end thereof connected via the contacts of a relay controlled switch 98 to breaker points 101 that act as an auxiliary to the fuel injector valves 79–81, as will be described in more detail hereafter.

It should be noted that there are two comparators 104 and 105. As explained above, a comparator is a well known electronic circuit element. These comparators have a predetermined EMF connected in parallel to one input of each. The circuit for thus connecting an EMF of predetermined amplitude, includes a circuit connection 106 for the comparator 104 and a connection 107 for comparator 105, respectively. These connections 106 and 107 both go to one end of a resistor 109, the other end of which is connected to a potentiometer output connection that is between two resistors 110 and 111. The lower end (as viewed in FIG. 3) of resistor 111 is connected to ground, as indicated, while the upper end of resistor 110 is connected via a circuit connection 114 to the circuit connection 87 described above. Connection 87 leads back via circuit connections 86, 85 and 84 to the positive terminal of the battery 69.

The other input of comparator 104 is connected via a circuit connection 113 to a common circuit that leads from the cathodes of a plurality of diodes 115, 116, 117, 118 and 119. The other electrodes of these diodes are each connected via capacitors 121, 122, 123, 124 and 125 respectively to each of the plungers of the fuel injector valves 78–81, plus the breaker points 101.

It may be observed that the circuits for each of the fuel injector valves are substantially similar. The action involves the change of electrical conductivity when the conductive material plunger (not shown) for each of the valves is lifted by fuel injection pressure. Such action may be described in connection with the fuel injector valve 78. When the injection pressure raises the plunger, this breaks the ground connection that was made via the valve seat and the body of the valve. Then, the electrical potential at a circuit point 128 will go from ground potential up to a high potential, as produced by the positive electrode of the battery 69. That change is reflected through the capacitor 121 to the ungrounded side of a resistor 129, and via the diode 115 to the circuit connection 113 that goes to one of the inputs of the comparator 104. It may be noted that each of the circuits for the other injector valves 79, 80, 81 and the breaker points 101 is similar to the foregoing and that separation between these circuits is maintained by the diodes 115–119.

The output of the comparator 104 goes to the base electrode of a transistor 132 which transmits a signal to initiate the electric spark signals that are created by the oscillator described above. The oscillator, of course, has outputs via the transformer 57 to the spark plugs 60.

An important aspect of the invention includes the function of the second comparator 105 and related circuits. Comparator 105 is connected to have its other (from that of circuit connection 107) input connection lead from the output of the comparator 104 via the transistor 132 and a time delay circuit. The arrangement acts as a time delay means to hold the output signal from comparator 104 for a predetermined length of time. Such length of time is determined by an RC circuit which includes a capacitor 135 and a resistor 136. These RC circuit elements are both in a circuit that goes through a resistor 139 to the other input of the comparator 105. The output of comparator 105 goes via circuit connections 141 and a resistor 142 to that other input connection 113 of the first comparator 104.

As indicated, this arrangement acts to hold the comparator 104 in its shifted state so long as the comparator 105 remains shifted, which latter time duration is determined by the RC circuit (capacitor 135 and resistor 136).

The output of transistor 132 goes via a capacitor 145 to an inverse (with repetition rate) pulse-width circuit 146. Pulse-width circuit 146 has its output connected via a circuit connection 149 to the base electrode of the electronic-switch transistor 68 (described above). This inverse pulse-width circuit 146 per se is not relevant to this invention. It merely acts to vary the pulse width of the output signals from the valve injectors, so as to create an inverse relationship relative to the speed (pulse repetition rate) of the internal combustion engine. Such an inverse pulse width circuit is known per se and consequently the details of its operation need not be described here.

It may be noted that the breaker points 101 and the related circuits, are so employed as to be particularly useful in connection with cold starting of the engine when the fuel injection pressure may not build sufficiently to actuate the fuel injection valves 78–81. Thus, the breaker points 101 are keyed to the engine operation so that they open approximately ten to fifteen degrees before top dead center, or in any event so that the points will open somewhat before the fuel injection which would have taken place under normal operation. In this manner, a spark signal will be obtained which is effective during engine cranking whether or not fuel injection takes place, and also when the cylinders are primed for cold starting. It will be noted that the switch 98 is controlled by a coil 152 of the switch relay. This relay may be actuated by a special cold start switch (not shown) in order to control energization of the coil 152 which actuates the switch 98. There is a second pole 151 of the switch 98 which controls the introduction of a resistor 154 in the pulse-width circuit 146, under cold start conditions.

OPERATION

Normal operation of the ignition may be reviewed in connection with one of the fuel injector valve circuits. Thus, considering conditions when the injector valves are not actuated because no fuel pressure has been applied to the plungers thereof, they make a direct connection to ground so that the voltage at the circuit point 128 is substantially zero. Then when the plunger of valve 78 is lifted, the voltage at point 128 will rise to the battery voltage of battery 69. This voltage increase will be transmitted through the capacitor 121 and the diode 115 to the input circuit connection 113 of the comparator 104. When this input voltage rise exceeds the predetermined voltage on circuit connection 106, the comparator will switch and an output signal will be applied via a circuit connection 155 and a resistor 156 to the base of the transistor 132. That causes the transistor 132 to conduct and thus pass a signal on via the capacitor 135 and over a circuit connection 159 to one end of the grounded resistor 136 as well as through the other resistor 139 to the other input of the comparator 105. That signal causes comparator 105 to switch immediately after comparator 104.

Now when comparator 105 switches, the output thereof goes over the circuit connections 141 and via the resistor 142 to the input connection 113 of the comparator 104. This holds comparator 104 in its switched position until the time delay period as determined by the RC circuit of the capacitor 135 and resistor 136, is completed. It will be understood that the holding action will eliminate the difficulty which would otherwise exist due to the uneven nature of the signal developed when the valve plunger is lifted by the fuel pressure. Also, during cold starting, if a valve plunger is lifted it will generate the signal that will actuate the comparator 104 and the breaker point signal will come during the time delay period so that it will be eliminated along with any other unwanted signals.

While a particular embodiment of the invention has been described above in considerable detail in accordance with the applicable statutes, this is not to be taken as in any way limiting the invention but merely as being descriptive thereof.

We claim:

1. In combination with an internal combustion engine employing fuel injection and including a high tension electric spark to ignite a combustible mixture of said injected fuel, a plurality of fuel injection valves each having an electrically conductive material plunger in seating contact with an electrically conductive material body of each valve when closed, said plungers being actuated by fuel pressure to open the valves, ignition breaker points being engine actuated to open after each of said fuel injection valves when operating normally, first electrical circuit means for connecting a resistor in series with each of said plungers and with said breaker points, a first and second comparator each having two inputs and an output, second circuit means for connecting a predetermined EMF to one of each of said comparator inputs in parallel, third circuit means comprising a diode in series with each of said plungers and said breaker points for maintaining electrical separation thereof, said third circuit means connecting said plungers and said breaker points to the other input of said first comparator, said first comparator output providing a signal to initiate said electric spark whenever any of said plungers are actuated by the fuel pressure or said breaker points are actuated, and time delay means connected to said first comparator output for maintaining said signal for a predetermined time duration, said time delay means comprising an RC circuit, said second comparator, fourth circuit means for connecting said RC circuit between said first comparator output and the other input of said second comparator, and fifth circuit means for connecting the output of said second comparator to said other input of said first comparator.

2. In combination with an internal combustion engine employing fuel injection and including a continuous AC type high tension electric spark to ignite a combustible mixture of said injected fuel, a fuel injection valve having an electrically conductive material plunger in seating contact with an electrically conductive material body of said valve when closed, said plunger being actuated by fuel pressure to open the valve, first electrical circuit means for connecting a resistor in series with said plunger, a comparator having two inputs and an output, second circuit means for connecting a predetermined EMF to one of said comparator inputs, third circuit means for connecting the other of said comparator inputs to said plunger, said comparator output providing a signal to initiate said electric spark when said plunger is actuated by the fuel pressure, and time delay means connected to said comparator output for maintaining said signal long enough to eliminate dynamic changes in the electrical resistance between said valve plunger and said valve body after the initial opening by fuel pressure.

3. The invention according to claim 2, wherein said time delay means comprises a second comparator having two inputs and an output, one of said second comparator inputs being connected in parallel with said one first comparator input to said predetermined EMF, the other of said second comparator inputs being connected to said spark initiating signal with an RC circuit to determine said time delay, and the output of said second comparator being connected to said other first comparator input to hold said spark initiating signal long enough to eliminate said dynamic changes.

4. The invention according to claim 3, further including a plurality of said injection valves, and wherein said third circuit means comprises a diode in series with each of said plungers for maintaining electrical separation.

5. The invention according to claim 4, further including auxiliary engine-actuated spark timing signal generating means, and wherein said third circuit means also comprises a diode in series with said auxiliary means for maintaining its electrical separation.

6. The invention according to claim 5, wherein said auxiliary engine-actuated spark timing signal generating means comprises breaker points.

* * * * *